United States Patent [19]

Gresser et al.

[11] Patent Number: 4,519,933

[45] Date of Patent: May 28, 1985

[54] METHOD OF PRODUCING DETERGENTS WITH LOWER LEVELS OF INCRUSTATION OF SALTS ON FABRICS BY INCORPORATING THEREIN ONLY TYPE A ZEOLITE DETERGENT BUILDERS HAVING A CERTAIN DETERMINED RATE CONSTANT

[75] Inventors: Robert Gresser; Max Michel, both of Lyons, France

[73] Assignee: Rhone-Poulenc Chimie de Base, Courbevoie, France

[21] Appl. No.: 501,915

[22] Filed: Jun. 7, 1983

[30] Foreign Application Priority Data

Jun. 18, 1982 [FR] France ..... 82 10638

[51] Int. Cl.[3] ..... C11D 3/06; C11D 3/12; C11D 11/00

[52] U.S. Cl. ..... 252/140; 423/329; 252/174.25; 252/179

[58] Field of Search ..... 252/140, 174.25, 179; 423/329

[56] References Cited

U.S. PATENT DOCUMENTS 4,073,867 2/1978 Roebke ..... 423/329
4,096,081 6/1978 Phenicie ..... 252/179 X
4,126,574 11/1978 Reinwald ..... 252/179
4,171,277 10/1979 Dankworth ..... 252/99
4,184,975 1/1980 Krings ..... 252/140
4,271,135 6/1981 Wuest ..... 423/329

FOREIGN PATENT DOCUMENTS 1563467 3/1980 United Kingdom ..... 252/174.25

*Primary Examiner*—Dennis L. Albrecht
*Attorney, Agent, or Firm*—Burns, Doane, Swecker & Mathis

[57] ABSTRACT

Type A, especially type 4A zeolites are well adapted as detergent builders, said zeolites comprising (i) primary particles having a mean particle diameter ranging from 0.1 to 10μ, (ii) a cation exchange capacity in excess of about 100 mg $CaCO_3$/g of anhydrous material, and (iii) a rate constant, relative to the surface area of the zeolite per liter of wash solution, in excess of about 0.15 $s^{-1}$ $lm^{-2}$. The builders are prepared by first determining the value of the rate constant for a given zeolite sample. Since a higher rate constant value corresponds to a lower degree of salt incrustation on fabrics, only those zeolites having a value above the predetermined minimum will be incorporated into detergents. Thus, zeolites otherwise appearing identical can be differentiated, with only those not causing high levels of incrustation being selected.

9 Claims, 4 Drawing Figures

METHOD OF PRODUCING DETERGENTS WITH LOWER LEVELS OF INCRUSTATION OF SALTS ON FABRICS BY INCORPORATING THEREIN ONLY TYPE A ZEOLITE DETERGENT BUILDERS HAVING A CERTAIN DETERMINED RATE CONSTANT

BACKGROUND OF THE INVENTION

1. Field of the Invention

The present invention relates to a zeolite of type A and to the use thereof as a detergent builder in detergent compositions for washing various materials, fabric or otherwise. More particularly, the present invention relates to a method of determining the different mineral incrustation properties between zeolites heretofore believed to be identical, i.e., with equal particle sizes, areas, exchange capacities after fifteen minutes, and equal times to carry out one-quarter of the exchange. This is achieved by calculating a parameter $k_s$ for a given type of zeolite A and by incorporating into detergent compositions only those zeolites having a $k_s$ value above a defined minimum. The present invention further relates to detergent compositions incorporating the zeolites obtained by the above method.

2. Description of the Prior Art

In this art, sodium tripolyphosphate (STPP) has long been considered to be the best detergent builder, particularly by reason of its dispersing capability, its capability to sequester alkaline earth metal ions and its solubility, which enables same to be discarded after use without leaving any traces.

Unfortunately, its eutrophization "properties" are suspect and the compound is considered an ecological-/environmental risk.

Thus, this art is replete with many and varied efforts to develop a substitute for STPP which would have the same advantages but not suffer from the defects thereof.

The natural response, therefore, was to turn to inorganic materials which were easily obtained and inexpensive, and particularly to silicoaluminates, which were well known for their cation exchanging capacity and had already been used in detergents in the past.

Synthetic zeolites, particularly of type A, too had appeared in the art and were well suited to fulfill this function, essentially because of their higher cation exchange capacity and greater purity. Moreover, based upon the knowledge that dispersion of bentonites, for example, was aided by the small size of the particles thereof, the natural reaction was to look to small particle sizes, on the order of from 0.1 to 10$\mu$.

Despite all of the immediately aforesaid, however, it was found that the zeolites were not suitable to replace sodium tripolyphosphate completely.

Indeed, published French Application No. 2,283,220 features the desideratum of even smaller particle sizes, despite the disadvantages which result therefrom, particularly in respect of ease of handling.

Also compare U.S. Pat. No. 4,210,416; published French Application Nos. 2,237,839, 2,291,268 and 2,396,086; published European Application Nos. 0,000,215 and 0,038,591.

SUMMARY OF THE INVENTION

In view of the foregoing, it should be apparent that there exists a need in the art for a method whereby, for a given zeolite particle size, surface area, and cationic exchange rate, the varying incrustation properties of the zeolite can nonetheless be determined with a view towards incorporating into the detergent only those zeolites which will not deposit undesirably high levels of minerals into fabrics. Accordingly, a major object of the present invention is the provision of an improved zeolite well adapted as a detergent builder which, given equal particle sizes, displays improved effectiveness in its detergent action compared with the zeolites hitherto employed for such purpose.

Moreover, as the rate of exchange of $Ca^{++}$ ions is known to have been linked with particle size, and both with the detergent action of zeolites, the present invention represents a marked departure from the state of the art.

Briefly, the above as well as other objects may be achieved by providing a method for determining the rate constant $k_s$ relative to the area of zeolite per liter of solution, expressed in $s^{-1}lm^{-2}$ and by providing a detergent incorporating the zeolites of the above method. The rake constant $K_s$ may be determined by use of the equation:

$$v = \frac{d(Ca^{2+})}{dt} = k_s(Ca^{2+})S$$

where v=the exchange capacity is $mgl^{-1}s^{-1}$; and S=the area of zeolite brought into play per liter of solution, expressed as $m^2l^{-1}$. It has been observed that the higher the $k_s$ value, the less incrustation will occur. Thus, the selected zeolites are well adapted as a detergent builder comprise a type A, particularly a type 4A zeolite, and are characterized in that they comprise:

(i) primary particles having a mean diameter ranging from 0.1 to 10$\mu$ and advantageously from 0.5 to 5$\mu$;

(ii) a theoretical cation exchange capacity of over 100 mg of $CaCO_3$/g of anhydrous product, and preferably over 200 mg; and (iii) a rate constant, relative to the zeolite surface, per liter of solution, of over 0.15, preferably over 0.25 and advantageously from 0.4 to 4 seconds$^{-1}$ liter meter$^{-2}$ ($s^{-1}lm^{-2}$), hereinafter referred to as $k_s$.

DETAILED DESCRIPTION OF THE INVENTION

Figure 1:
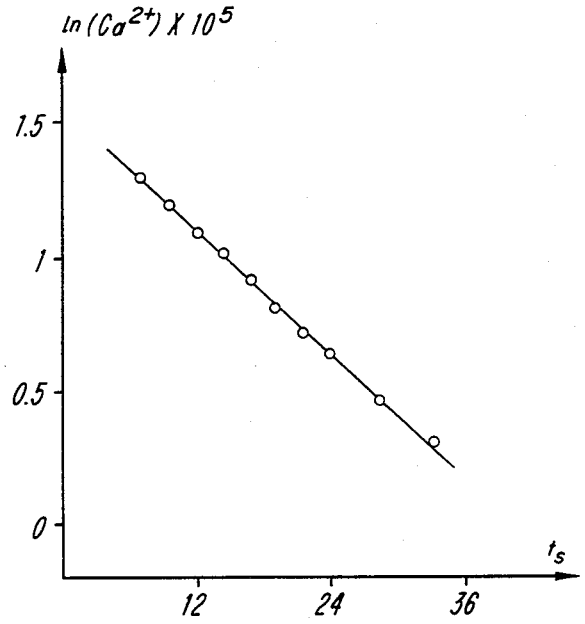

More particularly according to the present invention, the primary particles could be agglomerated together. The zeolite may equally as well be agglomerated with a different constituent of the wash composition.

It has also been demonstrated by applicants that, under the conditions of use in wash operations, the detergent effect represented by incrustation could be associated with a constant $k_s$, for a given particle size and surface area.

The surprising and unexpected observation has now been made that, with equal particle sizes and areas, with equal exchange capacities after 15 minutes and equal times required to carry out one-quarter of the exchange ($t\frac{1}{4}$), there results a different behavior in detergent action, particulary in respect of incrustation of insoluble salts on cotton fabric, and this behavior depends upon the value of said constant.

Indeed, it has been shown that the reaction of "initial calcium exchange" by a 4A zeolite, namely, within a range where the concentration of exchanged calcium is not more than 30 to 40% of the exchange capacity of the zeolite, may be described by a first order rate law relative to the calcium and a first order rate low relative to the zeolite.

The initial exchange rate V is expressed by:

$$V = \frac{d(Ca^{2+})}{dt} = k(Ca^{2+})\,(Zeol.) = k_s(Ca^{2+})S.$$

where:

(Zeol.): concentration of zeolite expressed in ppm of anhydrous zeolite;

k: second order rate constant, expressed as $s^{-1}ppm^{-1}$;

S: area of zeolite brought into play per liter of solution, measured with a scanning microscope, expressed as $m^2 l^{-1}$;

$k_s$: rate constant relative to the area of zeolite, per liter of solution, expressed in $s^{-1}lm^{-2}$.

The speed of the initial exchange of calcium by a zeolite can be measured by means of a "forced circulation cell" [A. M. Gary and J. P. Schwing, Bull. Soc. Chim., 9, 3654 (1972); A. M. Gary, E. Piemont, M. Roynette and J. P. Schwing, *Anal. Chem.*, 44, 198 (1972); A. M. Gary, Thesis Strasbourg (1970)], for long enough reaction half lives; for shorter reaction half lives it is measured by a stopped flow spectrophotometer. These two arrangements make it possible to obtain short enough mixing times, as not to disturb the kinetic measurement. After the rapid mixing of the reagents, the variation in the concentration of calcium over the course of time during the exchange reaction is followed by spectrophotometry in a heterogeneous medium, using a calcium indicator: murexide (wavelength 495 nm).

In order to further illustrate the present invention and the advantages thereof, the following specific example is given, it being understood that same is intended only as illustrative and in nowise limitative.

EXAMPLE

The characteristics of the specimens of zeolite 4A employed in this example are reported in the Table 1 which follows:

TABLE 1

| Zeolite specimens | Mean diameter of particles, in μm | Specific surface area (E.S.M.) of primary particles, $m^2$/g anhydrous | Morphology | Exchange capacity measured, mg $CaCO_3$/g anhydrous |
|---|---|---|---|---|
| A | 2.8 | 1.9 | cubic | 226 ± 10 |
| B | 2.8 | 1.9 | spherical | 233 ± 10 |
| C | 1.2 | 3.8 | spherical | 244 ± 12 |

Zeolites B and C were prepared in accordance with SN 299514.

The specific surface areas and diameter of the particles in the zeolite specimens were determined by calculation, by statistical analysis of the plates of the zeolites obtained with an electronic scanning microscope (E.S.M.).

The crystallinity ratios of each of the three specimens of zeolite 4A employed were over 90%.

The theoretical exchange capacities of the three zeolites were 352 mg $CaCO_3$/g anhydrous and the exchange capacity of the calcium reported in Table 1 was determined after 15 minutes in a medium of NaCl 3 g/l, using an electrode specific to calcium (ORION 93-20-00). The initial concentration of calcium utilized was 5. $10^{-3}$ mole $1^{-1}$ and the concentration of zeolite was 1 g (anhydrous)/liter. The temperature was 25° C. The medium (NaCl 3 g/l) was selected because of the desire to take the measurement in a medium with an ionic strength representative of that of a washing medium.

Using the method described above, the constant values $k_s$ were determined for the three specimens A, B, C.

The kinetic measurements were taken at 25° C.

The concentrations of the reagents employed in the kinetic measurements are reported in Table 2 which follows:

TABLE 2

| Zeolite specimen | Method of study | TBABr mole $1^{-1}$ | TBAOH mole $1^{-1}$ | Murexide mole $1^{-1}$ | $(Ca^{2+})$ o mole $1^{-1}$ |
|---|---|---|---|---|---|
| A | F.C.C. | 0.02 | $2.1 \cdot 10^{-3}$ | $2.38 \cdot 10^{-5}$ | $3.8 \cdot 10^{-5}$ |
| B(1) | S.S.F. | 0.02 | $2.2 \cdot 10^{-3}$ | $10^{-5}$ | $2 \cdot 10^{-5}$ |
| B(2) | F.C.C. | 0.02 | $2.1 \cdot 10^{-3}$ | $2.38 \cdot 10^{-5}$ | $3.8 \cdot 10^{-5}$ |
| C | S.S.F. | 0.02 | $2.2 \cdot 10^{-3}$ | $10^{-5}$ | $2 \cdot 10^{-5}$ |

F.C.C.: forced circulation cell
S.S.F.: stopped flow spectrophotometer
TBABr: tetrabutylammonium bromide
TBAOH: tetrabutylammonium hydroxide The quantities of zeolite used in the kinetic measurements were selected such that the initial concentration of calcium did not exceed 30 to 40% of the exchange capacity of the zeolite.

BRIEF DESCRIPTTION OF THE DRAWINGS

Figure 2:
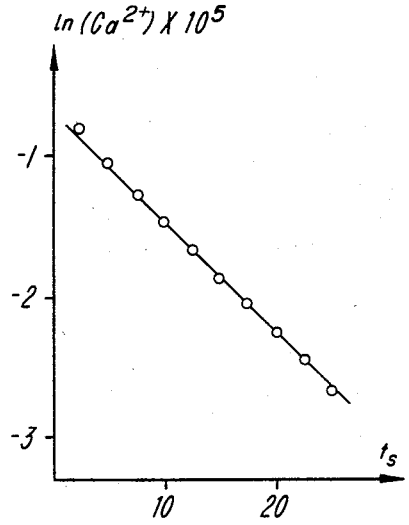
Figure 3:
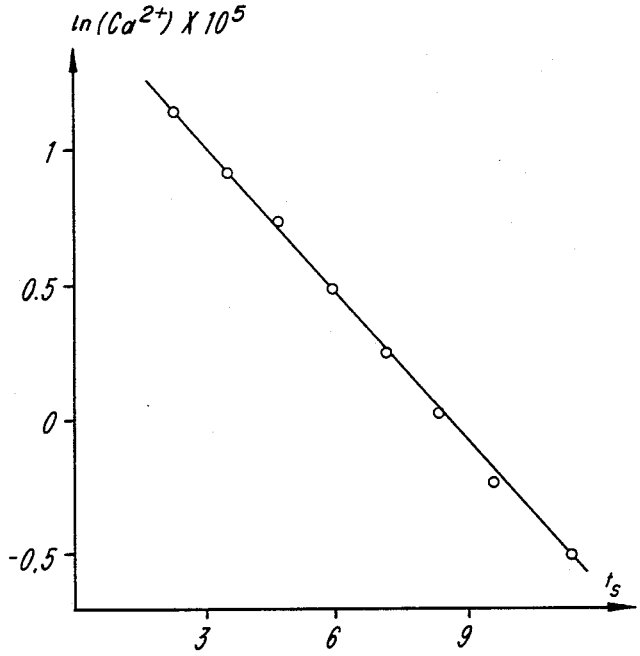
Figure 4:
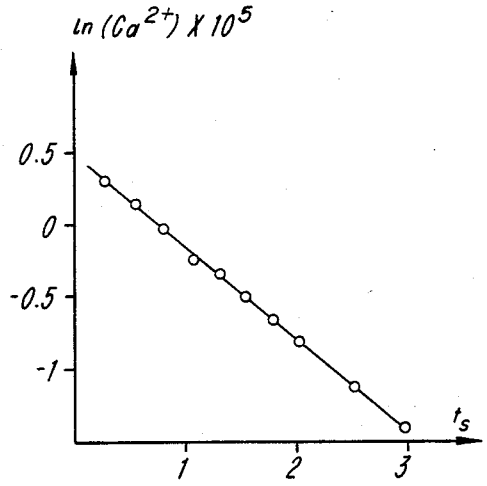

FIGS. 1 to 4 of the Drawings illustrate, by way of example, the variations of ln $Ca^{2+}$ as a function of time, which were thus obtained for specimens, A, B(1), B(2) and C for respective zeolite concentrations of 143, 50, 143, 50 ppm (parts per million).

These variations are linear, a fact which confirms the hypothesis of a first order reaction relative to calcium with an apparent rate constant $k_{app}$ given by the slopes of the straight lines ln $[Ca^{2+}]=f(t)$. This first order law is also confirmed when the concentration of zeolite varies within the range in question, and the variation of $k_{app}$ with the concentration of zeolite is a straight line passing through the point of origin, thus demonstrating that the initial exchange reaction may be described by a first order rate law relative to calcium and a first order rate law relative to zeolite.

Table 3 which follows reports the values of the constant $k_s$ for the zeolite specimens utilized.

TABLE 3

| Zeolite specimen | Method of study | $k_s$ $s^{-1}$ 1 $m^{-2}$ |
|---|---|---|
| A | F.C.C. | 0.14 |
| B(1) | S.S.F. | 0.73 |
| B(2) | F.C.C. | 0.68 |
| C | S.S.F. | 3.2 |

F.C.C.: forced circulation cell
S.S.F.: stopped flow spectrophotometer

It will be appreciated that for sample B the two methods, F.C.C. and S.S.F., give similar values; a value of 0.7 will be recorded.

The three specimens were tested for their detergent power. The values of $t(\frac{1}{4})$ were also determined for the three specimens A, B and C. In accordance with DE-AS No. 2,422,655, this is the time required to exchange $\frac{1}{4}$ of the ions representing the hardness of the water (col. 22, pp. 42–43).

In the aforedescribed application, this parameter is measured by means of an electrode specific to divalent ions, by tracing the concentration of calcium during the exchange reaction, in the presence of a magnesium concentration equal to half the initial calcium concentration (hardness conditions of American water). The use of a specific electrode has the disadvantage of seriously upsetting the kinetic measurement during the first few seconds of the reaction, because of the response time of the electrode, and for this reason it has been found preferable to employ the following method:

A mixture of calcium and magnesium is injected into a cell, which is set thermostatically to 25° C. and which contains 100 ml of a zeolite suspension (0.03%), such that the initial concentrations of calcium and magnesium are respectively $1.37.10^{-3}$ and $0.685.10^{-3}$ mol $l^{-1}$ (the concentrations used in the test described in DE-AS No. 2,422,655).

The calcium concentration was determined at various stages by ascertaining the amount of $Ca^{2+}$ (atomic absorption) contained in the solution obtained by withdrawing a small volume of solution and filtering it as quickly as possible.

The times required to obtain one quarter of the exchange equilibrium which were obtained in this manner for specimens A, B and C are reported in Table 4.

TABLE 4

| Zeolite specimen | t (¼) s |
|---|---|
| A | 3 |
| B | 3 |
| C | 3 |

The difference which may exist between these specimens is within the range of experimental error.

This measurement should not, therefore, be considered as representing the detergent action of specimens A, B and C, any more than the exchange capacity does.

The following incrustation tests were carried out to demonstrate the effect of the zeolite according to the invention:

As a means for comparing the incrustation performance of zeolites A, B and C, a series of washing cycles was carried out, using a detergent formulation with a mixed TPP/zeolite builder having the following composition:

| | Constituents | % by weight |
|---|---|---|
| (i) | linear sodium dodecylbenzene sulfonate | 7.5% |
| (ii) | Sodium stearate | 3% |
| (iii) | linear $C_{18}$ alcohol, ethoxylated with 12 moles of ethylene oxide | 3% |
| (iv) | linear $C_{18}$ alcohol, ethoxylated with 50 moles of ethylene oxide | 2% |
| (v) | Anhydrous sodium tripolyphosphate | 13.75% |
| (vi) | Zeolite A, B or C | 13.75% |
| (vii) | Sodium pyrophosphate | 2% |
| (viii) | Trisodium phosphate | 0.5% |
| (ix) | Sodium silicate with 20% water | 8.6% |
| (x) | Sodium sulfate | 17.5% |
| (xi) | Carboxymethylcellulose | 1.5% |
| (xii) | Optical brighteners | 0.4% |
| (xiii) | Enzymes | 0.3% |
| (xiv) | Perborate, $3H_2O$ | 25% |
| (xv) | Magnesium silicate | 1% |
| (xvi) | EDTA Na | 0.2% |

Cumulated washing cycles were carried out in a tergotometer at 60° C. The concentration of washing solution used was 6 g/l and the hardness of the water was 32° H.T. (NFT 90 003) $[Ca^{++}]/[Mg^{++}] \sim 5$ molar ratio. Each cycle comprised a 20 minute washing phase and three rinses in hard water. Each dish in the tergotometer contained twelve pieces of cotton fabric (ref. 405 Testfabric, dimensions 10×12 cm). The quantity of solution in each wash and each rinse was 1 liter per dish.

Incrustation was then assessed after 5, 10, 20 and 30 washing cycles, as follows:

Analysis (by X-ray fluorescence) of the ash obtained by calcining the samples of fabric evidenced that the incrustation essentially comprised pentacalcium phosphate $Ca_5(P_3O_{10})_2$ and insoluble calcium salts; the quantity of zeolite in the ash was negligible, not exceeding 5%. An assessment of incrustation can thus be given by the proportion of calcium and the proportion of $Ca_5(P_3O_{10})_2$ (determined by measuring the amount of calcium and phosphorus in the ash).

The weights of calcium and $Ca_5(P_3O_{10})_2$ thus determined per 100 g of fabric are reported in the following Table 5:

TABLE 5

| Builder | No. of cycle | Weight (g) of constituent per 100 g of fabric | |
|---|---|---|---|
| | | Ca | $Ca_5(P_3O_{10})_2$ |
| TPP/ zeolite A | 5 | 0.27 | 0.45 |
| | 10 | 0.64 | 1.43 |
| | 20 | 1.48 | 3.81 |
| | 30 | 2.63 | 7.40 |
| TPP/ zeolite B | 5 | 0.17 | 0.30 |
| | 10 | 0.48 | 1.04 |
| | 20 | 1.13 | 2.84 |
| | 30 | 2.27 | 6.04 |
| TPP/ zeolite C | 5 | 0.25 | 0.34 |
| | 10 | 0.43 | 0.92 |
| | 20 | 1.05 | 2.45 |
| | 30 | 1.86 | 4.81 |

The results demonstrated a significant reduction in incrustation when comparing zeolite A with zeolite B and sample C: after 30 cumulated washing cycles, the proportions of calcium and $Ca_5(P_3O_{10})_2$ were lowered by 14% and 18%, respectively, when one changes from zeolite A to zeolite B. In the case of specimen C, these proportions were respectively reduced by 30 to 35% compared with zeolite A and by 18 and 20% compared with specimen B.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. A method of producing a detergent including a surfactant and a zeolite detergent builder having improved detergent effect represented by lower levels of incrustation of salts on fabrics comprising the steps of:

providing a type A zeolite having a mean particle diameter ranging from 0.1–10 microns and a cation exchange capacity in excess of about 100 mg $CaCO_3$ per gram of anhydrous material;

determining a rate constant $k_s$ relative to the surface area of zeolite per liter of solution;

incorporating only those zeolites having $k_s$ values in excess of about 0.15 $s^{-1}lm^{-2}$ in said detergents.

2. The method of producing detergents as defined by claim 1, said type A zeolite comprising a zeolite of type 4A.

3. The method of producing detergents as defined by claim 1, said rate constant (iii) being in excess of about $0.25^{-1}\ s^{-1}lm^{-2}$.

4. The method of producing detergents as defined by claim 1, said rate constant ranging from about 0.4 to 4 $s^{-1}lm^{-2}$.

5. The method of producing detergents as defined in claim 4, said type A zeolite comprising a cation exchange capacity (ii) in excess of about 200 mg $CaCO_3$/g of anhydrous material.

6. The method of producing detergents as defined by claim 5, said type A zeolite comprising primary particles (i) having a mean particle diameter ranging from 0.5 to 5$\mu$.

7. The method of producing detergents as defined by claim 1, said type A zeolite comprising primary particles which are agglomerated together.

8. The method of producing detergents as defined in claim 1, said type A zeolite comprising primary particles agglomerated with another constituent of the detergent composition.

9. The method of producing detergents as defined by claim 1 wherein said step of determining the rate constant $k_s$ further comprises the steps of:

measuring the area of zeolite per volume of a solution;

measuring cation concentration at various time intervals; and calculating $k_s$.

* * * * *